US011517160B2

(12) United States Patent
Kim et al.

(10) Patent No.: US 11,517,160 B2
(45) Date of Patent: Dec. 6, 2022

(54) VACUUM CLEANER

(71) Applicant: SAMSUNG ELECTRONICS CO., LTD., Suwon-si (KR)

(72) Inventors: Taegwang Kim, Suwon-si (KR); Dongwoo Ha, Suwon-si (KR); Kihwan Kwon, Suwon-si (KR); Kyoungwoong Kim, Suwon-si (KR); Seokman Hong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/992,368

(22) Filed: Aug. 13, 2020

(65) Prior Publication Data

US 2021/0045599 A1 Feb. 18, 2021

(30) Foreign Application Priority Data

Aug. 14, 2019 (KR) ..... 10-2019-0099488
Dec. 26, 2019 (KR) ..... 10-2019-0174852

(51) Int. Cl.
*A47L 9/04* (2006.01)
*A46B 13/02* (2006.01)
*A46B 13/00* (2006.01)

(52) U.S. Cl.
CPC ..... *A47L 9/0477* (2013.01); *A46B 13/001* (2013.01); *A46B 13/02* (2013.01); *A47L 9/0411* (2013.01)

(58) Field of Classification Search
CPC .... A47L 9/0477; A47L 9/0411; A46B 13/001; A46B 13/02; A46B 13/006; A46B 15/0053
See application file for complete search history.

(56) References Cited

U.S. PATENT DOCUMENTS 1,907,642 A 5/1933 Demaree
2,411,488 A * 11/1946 White ..... A47L 9/0411 29/451
4,209,873 A * 7/1980 Schaefer ..... A47L 5/30 15/182

(Continued)

FOREIGN PATENT DOCUMENTS

GB 2491738 A 12/2012
JP 7-16182 1/1995

(Continued)

OTHER PUBLICATIONS

International Search Report and Written Opinion of the International Searching Authority dated Nov. 11, 2020 in International Patent Application No. PCT/KR2020/010638.

(Continued)

*Primary Examiner* — Anne M Kozak
*Assistant Examiner* — Michael A Gump
(74) *Attorney, Agent, or Firm* — Staas & Halsey LLP

(57) ABSTRACT

A vacuum cleaner including: a cleaner main body configured to generate suction force; and a suctioner including a head having a suction inlet to suck dust by the suction force and a brush drum rotatably provided in the suction inlet to sweep dust on a floor. The brush drum includes convex portions projected from an outer circumferential surface of the brush drum and spirally extended in a rotational axial direction of the brush drum.

13 Claims, 23 Drawing Sheets

(56) References Cited

U.S. PATENT DOCUMENTS

| | | | | |
|---|---|---|---|---|
| 5,003,663 | A * | 4/1991 | Sunagawa | A47L 5/30 15/182 |
| 5,452,490 | A * | 9/1995 | Brundula | A47L 9/0477 15/207.2 |
| 6,760,952 | B1 * | 7/2004 | Stegens | A47L 9/0477 15/366 |
| 7,079,923 | B2 * | 7/2006 | Abramson | A47L 5/22 180/167 |
| 10,004,370 | B2 | 6/2018 | Isley et al. | |
| 2008/0172827 | A1 | 7/2008 | Oh et al. | |
| 2008/0244843 | A1 * | 10/2008 | Hui | A46B 13/02 15/1.7 |
| 2009/0229075 | A1 * | 9/2009 | Eriksson | A47L 9/0477 15/48 |
| 2010/0306957 | A1 * | 12/2010 | Follows | A47L 9/0477 15/363 |
| 2015/0335220 | A1 | 11/2015 | Kim et al. | |
| 2016/0183749 | A1 | 6/2016 | Isley et al. | |
| 2016/0278595 | A1 | 9/2016 | Shim et al. | |
| 2019/0000289 | A1 | 1/2019 | Lim et al. | |
| 2020/0352403 | A1 | 11/2020 | Kim | |

FOREIGN PATENT DOCUMENTS

| | | |
|---|---|---|
| JP | 2007-282880 | 11/2007 |
| RU | 2 364 310 C1 | 8/2009 |
| WO | WO 2019/093655 A1 | 5/2019 |

OTHER PUBLICATIONS

European Search Report issued in European Application No. 20851482.8 dated May 2, 2022.

* cited by examiner

VACUUM CLEANER

CROSS-REFERENCE TO RELATED APPLICATION

This application is based on and claims priorities from Korean Patent Applications No. 10-2019-0099488, filed on Aug. 14, 2019 and No. 10-2019-0174852, filed on Dec. 26, 2019 in the Korean Intellectual Property Office, the disclosures of which are incorporated herein by reference.

BACKGROUND

Field

The disclosure relates to a vacuum cleaner, and more particularly, to an improvement of a brush drum applying to a vacuum cleaner.

Description of the Related Art

A stick-type vacuum cleaner includes a cleaner main body for generating a suction force, a suctioner for sucking dust or dirt from a cleaning surface such as a carpet and a stick having a connection rod having a passage through which dust or dirt sucked by the suctioner is delivered. The stick may have its top portion connected to the cleaner main body and its bottom portion connected to the suctioner. The cleaner main body includes a dust container to accommodate therein dust or dirt that has been sucked through the stick. The suctioner includes a rotating brush drum.

The brush drum includes a cylindrical drum and a brush having a plurality of bristles surrounding an outer circumferential surface of the drum. In the conventional vacuum cleaner described above, the brush is in close contact with a cleaning surface in a rotational axial direction during a cleaning process, and thus frictional force between the brush drum and the cleaning surface increases, resulting in great noise and an increase in power consumption due to an increase in a load of rotation of the drum.

SUMMARY

Accordingly, an aspect of one or more embodiments may provide a vacuum cleaner. The vacuum cleaner includes: a cleaner main body configured to generate suction force; and a suction unit including a head having a suction inlet to suck dust by the suction force and a brush drum rotatably provided in the suction inlet to sweep dust on a floor. The brush drum includes convex portions projected from an outer circumferential surface of the brush drum and spirally extended in a rotational axial direction of the brush drum.

The brush drum may include: a drum main body having the convex portions formed on an outer circumferential surface of the brush drum; and a cleaning member including a base surrounding the drum main body and a plurality of bristles supported by the base.

The brush drum may include: a cylindrical drum main body: and a cleaning member including a base surrounding the drum main body and having the convex portions, and a plurality of bristles provided in the base.

The brush drum may include the plurality of convex portions.

Each of the convex portions may be provided to surround a rotational shaft of the brush drum and may include at least one contact point to a floor cleaning surface.

The convex portions may be configured to have a predetermined radius of curvature in a circumferential direction of the brush drum.

Arches with a lower height than the convex portions may be arranged between the convex portions.

The arches may include the same radius of curvature from a center of rotation.

The suctioner may include a housing partially surrounding the brush drum.

The housing may be configured to surround the brush drum in an opposite side of a floor and extends in a front of the suctioner, and an extending front end of the housing may be configured to project as high as, or higher than, the brush drum in a front direction.

The plurality of bristles may have the same height.

The plurality of bristles may include the same or two or more materials.

The plurality of bristles may include at least one of nylon filaments, silver yarn filaments or carbon filaments.

The brush drum may include: a cylindrical drum main body; and an elastic member supported by an outer circumferential surface of the drum main body and including a material softer than the drum main body.

The drum main body may include at least one groove having the convex portion on a bottom thereof, and the elastic member may be inserted into and attached to the groove.

The elastic member may include a material that is more elastic than the drum main body.

The drum main body may include the convex portion, and the elastic member may be in a consistent thickness.

The elastic member may include the convex portion.

The elastic member may include a single member.

The elastic member may include a plurality of members.

BRIEF DESCRIPTION OF THE DRAWINGS

The above and/or other aspects will become apparent and more readily appreciated from the following description of embodiments, taken in conjunction with the accompanying drawings, in which.

DETAILED DESCRIPTION OF EMBODIMENTS

Below, embodiments of a vacuum cleaner 1 will be described in detail with reference to accompanying drawings, to be easily carried out by a person having an ordinary skill in the art. The embodiments are described to apply to a stick-type vacuum cleaner to help understanding of the disclosure, but not limited thereto. The disclosure may be embodied in various different forms such as a handy type, handy-stick type, canister type vacuum cleaner, upright-type vacuum cleaner, and robot cleaner. However, detailed description on related functions in public domain or on elements and detailed illustration thereof will be omitted if it is determined that such detailed description and detailed illustration may unnecessarily blur the substance of the disclosure.

In order to resolve the problem of the conventional art, a vacuum cleaner which is able to make less noise by reducing frictional force between a drum and a cleaning surface and to reduce power consumption by reducing a load of rotation of the drum is provided.

Also, a vacuum cleaner which is able to effectively suck dust from corners is provided.

Figure 1:
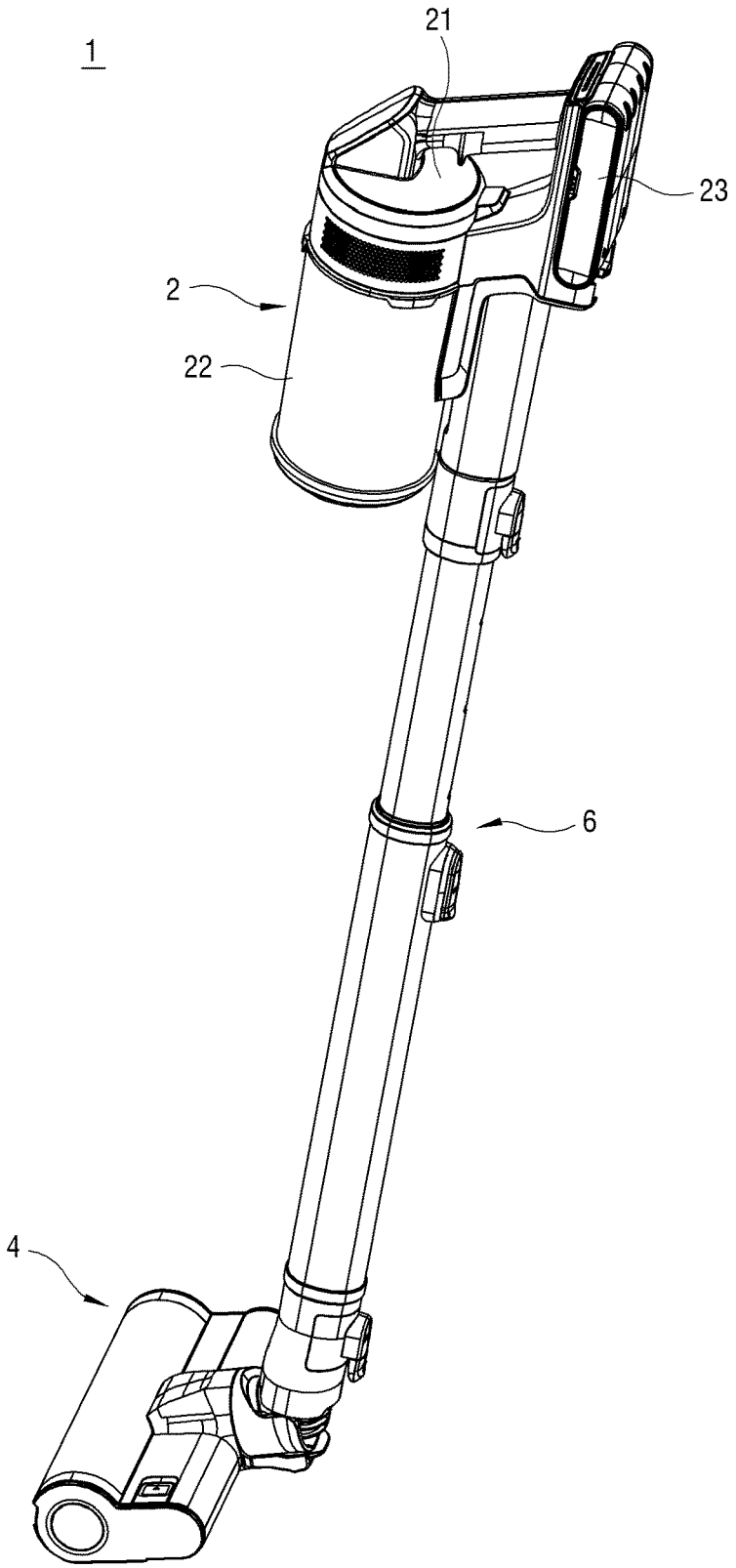
FIG. 1 is a perspective view of a vacuum cleaner according to a first embodiment of the disclosure.

FIG. 1 is a perspective view of a vacuum cleaner 1 according to a first embodiment of the disclosure. The vacuum cleaner 1 according to the first embodiment of the disclosure may include a cleaner main body 2, a suction unit (suctioner or suction member) 4 for sucking dust or dirt from a cleaning surface, and a connection rod or tube 6 transferring dust or dirt sucked by the suction unit 4 to the cleaner main body 2.

The cleaner main body 2 may include a suction motor 21 generating suction force, a filter assembly 22 filtering sucked dust or dirt, and a battery 23 supplying power to the suction motor 21. The cleaner main body 2 may further include a controller controlling the suction motor 21, and a manipulator for manipulating an on or off operation of the vacuum cleaner 1.

The suction motor 21 generates suction force to suck dust or dirt.

The filter assembly 22 is detachably attached to the suction motor 21 to filter dust or dirt in the air sucked from a cleaning surface through the suction unit 4 and the connection rod 6 by suction force.

The filter assembly 22 may include a dust collecting container for collecting filtered dust or dirt, a filter provided in the dust-collecting container leaving a space therein, e.g. cyclone.

The dust collecting container may suck air introduced through the suction unit 4 and the connection rod 6 through an air inlet. The air sucked as above may be filtered with dust or dirt through a filer in the dust collecting container, and then transferred to the suction motor 21 to be discharged to the outside.

The battery 23 may be implemented as a rechargeable secondary cell. The battery 23 supplies power to the suction motor 21 and the suction unit 4. The battery 23 may include a charging terminal.

The suction unit 4 may suck dust or dirt from a cleaning surface with suction force of the cleaner main body 2 to perform a cleaning operation.

The connection rod 6 may include a plurality of pipes having a hollow part inside to form an air passage between the cleaner main body 2 and the suction unit 4. The connection rod 6 may be formed by flexibly coupling a plurality of pipes.

Figure 2:
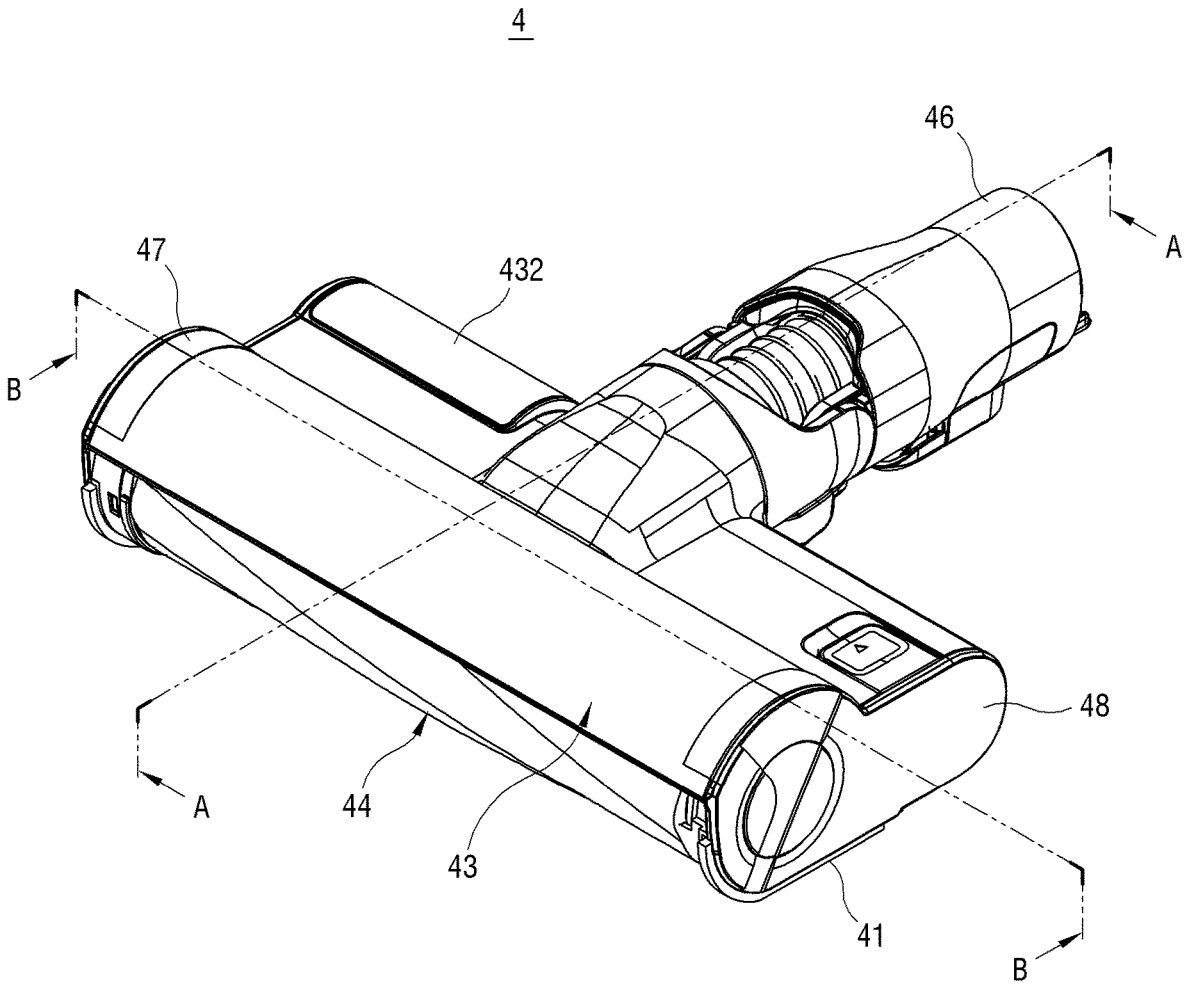
FIG. 2 is a perspective view of a suction unit in FIG. 1.
Figure 3:
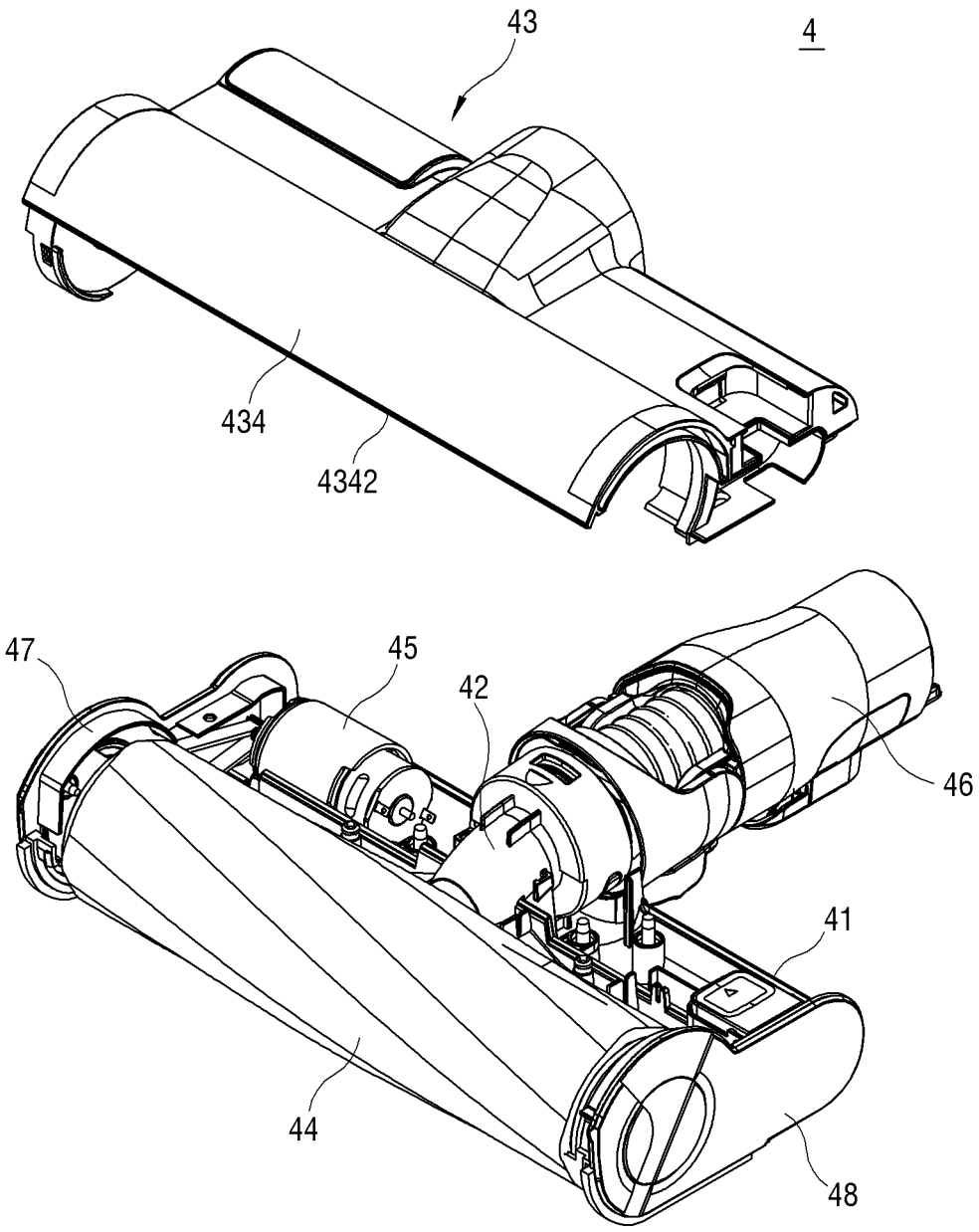
FIG. 3 is a perspective view showing the suction unit in FIG. 2 from which an upper cover has been separated.
Figure 4:
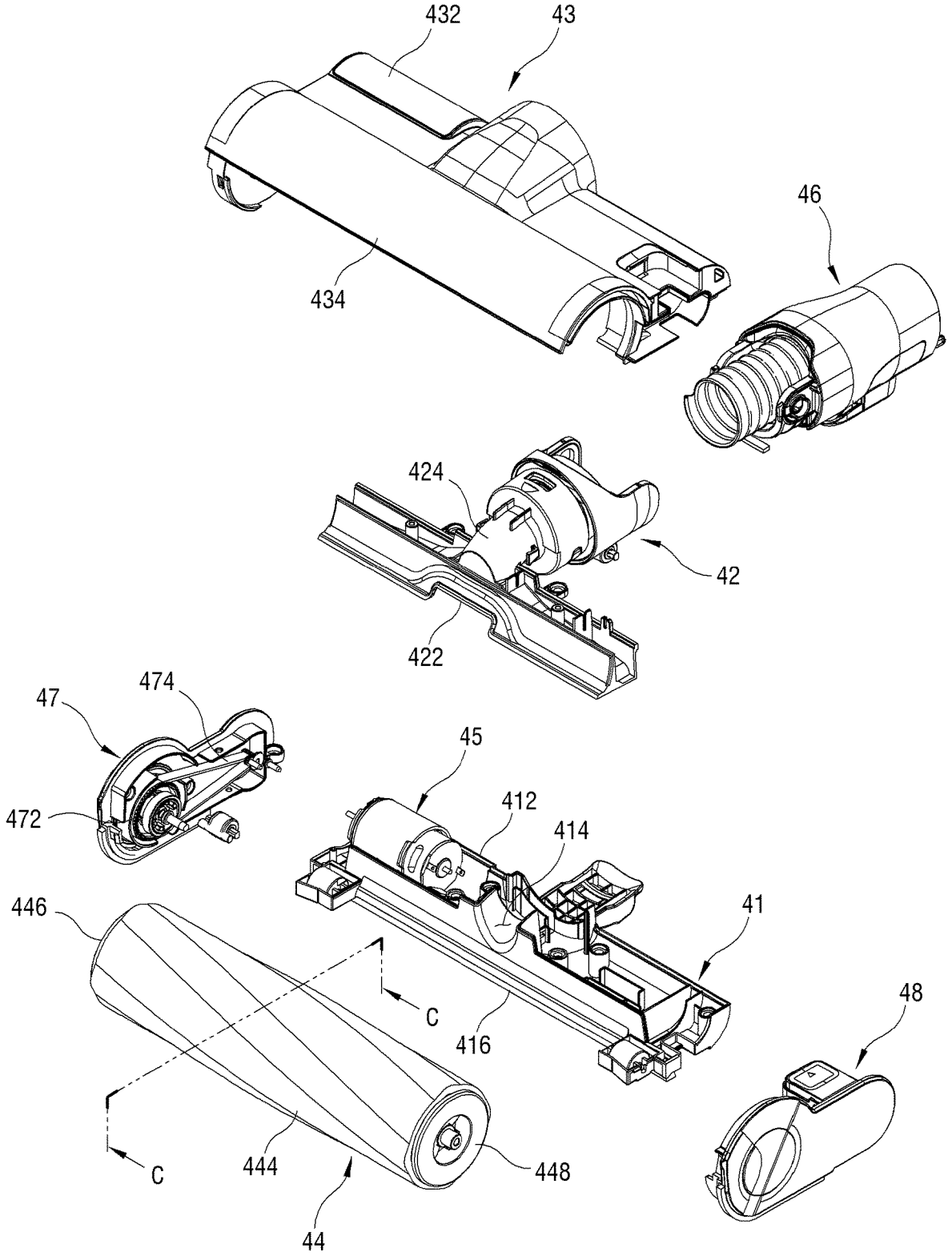
FIG. 4 is an exploded perspective view of the suction unit in FIG. 2.
Figure 5:
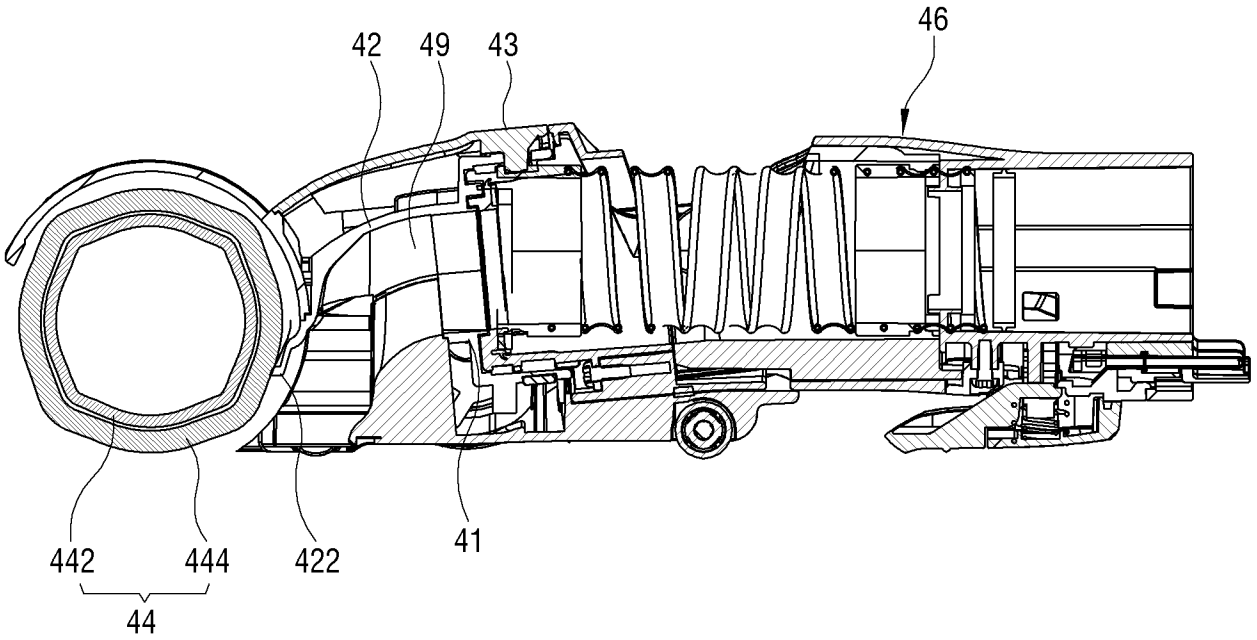
FIG. 5 is a cross-sectional view taken along line A-A in FIG. 2.

FIG. 2 is a perspective view of the suction unit 4 in FIG. 1. FIG. 3 is a perspective view showing the suction unit 4 in FIG. 2 from which an upper cover 43 has been separated. FIG. 4 is an exploded perspective view of the suction unit 4 in FIG. 2. FIG. 5 is a cross-sectional view taken along line A-A in FIG. 2.

Referring to FIGS. 2 to 5, the suction unit 4 may include a lower frame 41, a dust guide 42 forming a suction space 49 (refer to FIG. 5) by being coupled to the lower frame 41, an upper cover 43 covering an upper part of the dust guide 42, a brush drum 44 rotating and sweeping dust from a cleaning surface, and a drum motor 45 provided in the lower frame 41 and rotating the brush drum 44.

The suction unit 4 as a suctioner may include a rod connector 46 provided between the suction space 49 formed by the lower frame 41 and the dust guide 42, and the connection rod 6, and a first and second drum supporters 47 and 48 provided on opposite ends of the brush drum 44 and rotatably supporting the brush drum 44.

The lower frame 41 may include a motor accommodation unit 412 (refer to FIG. 4) to accommodate the drum motor 45 therein and a lower passage 414 forming a lower part of the suction space 49 (refer to FIG. 5) and shaped like, e.g. a semi-cylinder. The lower frame 41 includes an opening 416 to be opened toward a floor cleaning surface. Dust may be introduced to the suction space 49 through the opening 416. The lower frame 41 may include a plurality of rollers to be moved by being spaced from a floor.

The dust guide 42 may include a contacting portion 422 to sweep dust off by contacting an outer circumferential surface of the brush drum 44 and a guide portion 424 to guide air containing dust. The dust guide 42 may be coupled to the lower frame 41.

The upper cover 43 may include a motor cover 432 (refer to FIG. 4) to cover the drum motor 45, and a housing 434 to partially cover the brush drum 44 shaped like a cylinder. The housing 434 is arranged above an outer circumferential surface of the brush drum 44 to form a predetermined space with respect to the brush drum 44.

The brush drum 44 brushes dust off a floor cleaning surface, in particular, those deeply stuck among a lot of bristles in a carpet to scatter the dust to the top of the carpet.

The drum motor 45 generates power to rotate the brush drum 44. The drum motor 45 may be driven by power supplied by the battery 23 of the cleaner main body 2 through the connection rod 6.

The rod connector 46 may have one side detachably attached to the connection rod 6 and the other side flexibly coupled to the dust guide 42. The rod connector 46 has a space inside to connect the suction space 49 and the hollow part of the connection rod 6.

The first drum supporter 47 may rotatably support a first end part of the brush drum 44. The first drum supporter 47 may include a belt pulley 472 (refer to FIG. 4) to be coupled to a first end part of the drum main body 442 (refer to FIG. 5) and a driving belt 474 to transfer driving force between the belt pulley 472 and the drum motor 45. The belt pulley 472 may include a bearing to rotate.

The second drum supporter 48 may rotatably support a second end part of the brush drum 44.

Figure 6:
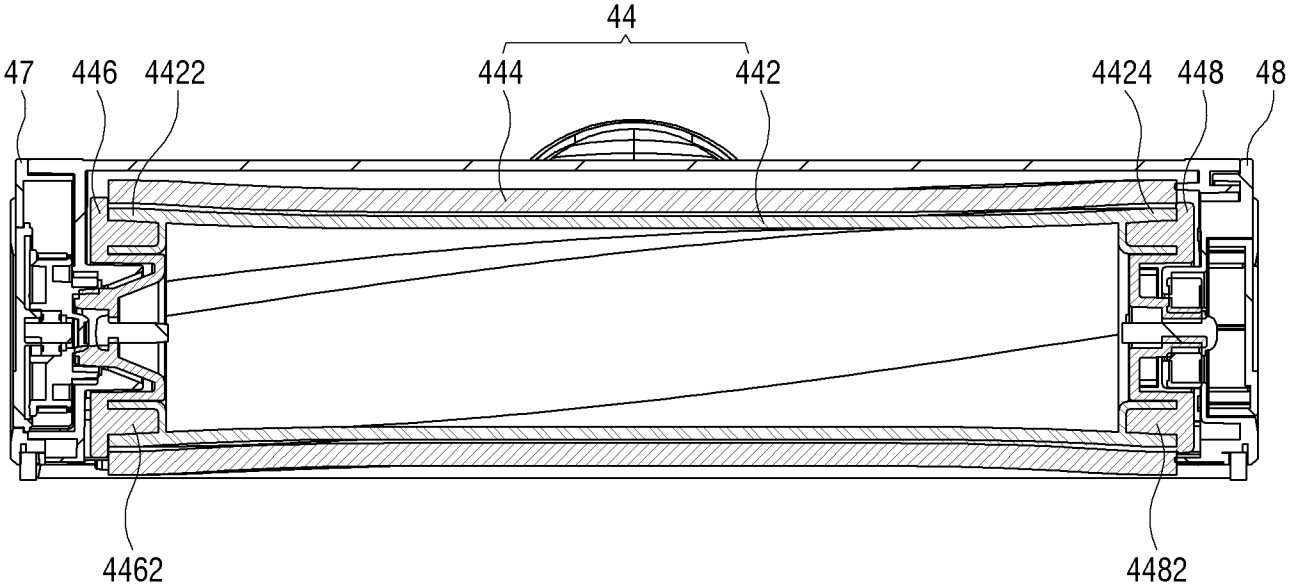
FIG. 6 is a cross-sectional view taken along line B-B in FIG. 2.
Figure 7:
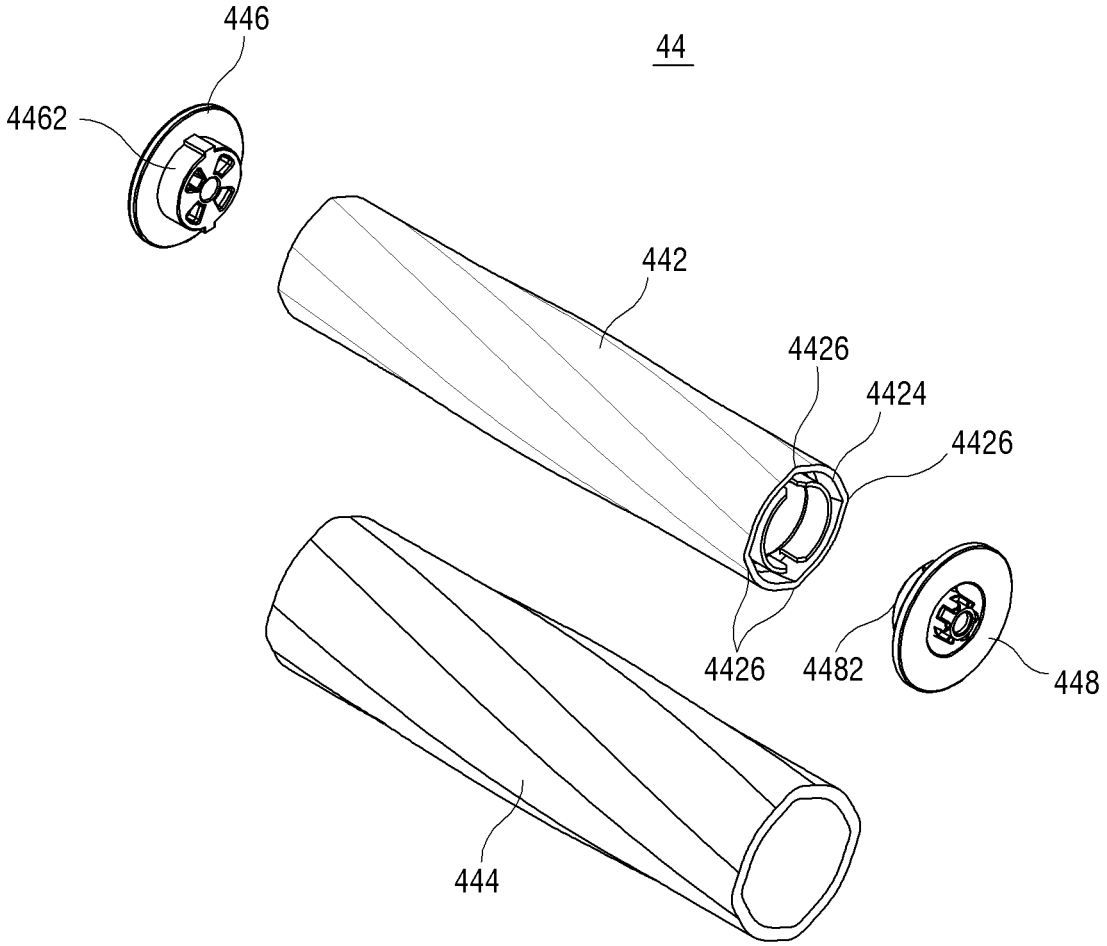
FIG. 7 is an exploded perspective view of a brush drum in FIG. 6.
Figure 8:
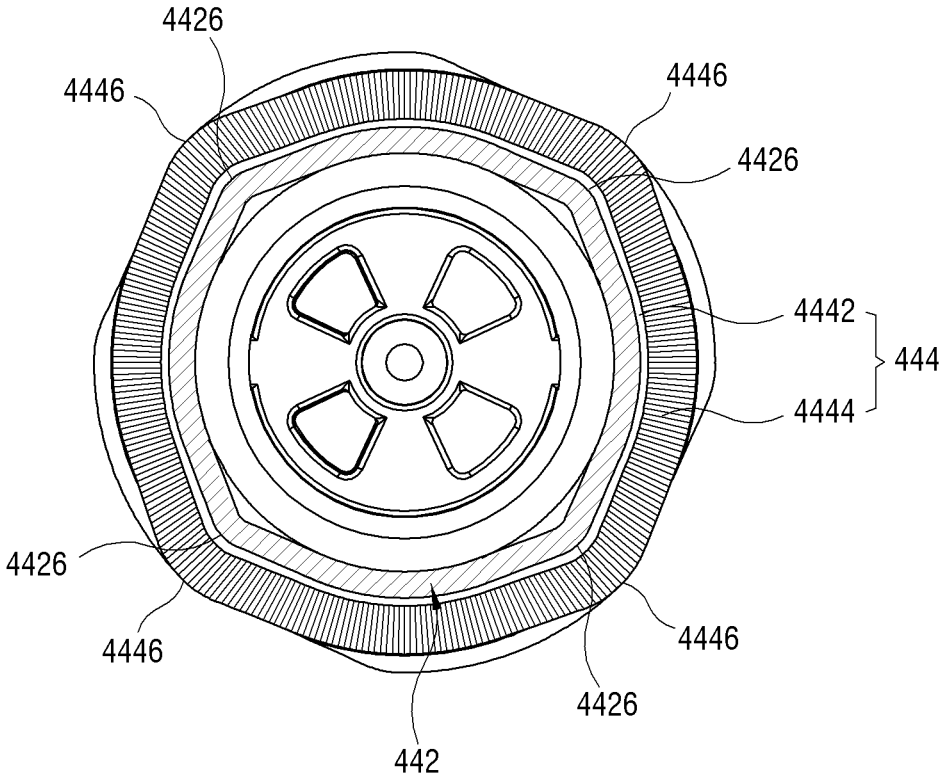
FIG. 8 is a cross-sectional view taken along line C-C in FIG. 4.

FIG. 6 is a cross-sectional view taken along line B-B in FIG. 2. FIG. 7 is an exploded perspective view of the brush drum 44 in FIG. 6. FIG. 8 is a cross-sectional view taken along line C-C in FIG. 4.

Referring to FIGS. 6 to 8, the brush drum 44 may include the drum main body 442 shaped like a rotating stick, a cleaning member 444 formed on an outer circumferential surface of the drum main body 442, a first drum coupling part 446 inserted into and fixed to a first end part of the drum main body 442 and a second drum coupling part 448 inserted into and fixed to a second end part of the drum main body 442.

The drum main body 442 may be manufactured by injection molding with plastic, etc. The drum main body 442 is shaped like a container having a hollow part inside. The drum main body 442 may include first and second grooves 4422 and 4424 formed on opposite ends thereof and shaped like a column. Into the first and second grooves 4422 and 4424, a column-shaped first projection 4462 of the first drum coupling part 446 and a column-shaped second projection 4482 of the second drum coupling part 448 may be inserted, respectively.

The drum main body 442 may include, e.g. four convex portions 4426 that project from an outer circumferential surface of the drum main body 442 in a radial direction, but the convex portions 4426 are not limited thereto. The convex portions 4426 may spirally extend from an outer circumferential surface of the drum main body 442 in an axial direction.

The cleaning member 444 may include a base 4442 attached to an outer circumferential surface of the drum main body 442 and a plurality of bristles or filaments 4444 supported by the base 4442. The plurality of bristles or filaments 444 may include bristles for cleaning use such as cotton flannel including nylon yarn and antistatic bristles such as silver yarn, carbon yarn and conductive wire. The plurality of bristles or filaments 4444 may have the same height from the base 4442. Accordingly, the cleaning member 444 may have a projecting outer circumferential surface 4446 like the first convex portion 4426 by being attached to an outer circumferential surface of the drum main body 442 having the convex portions 4426.

The cleaning member 444 may be wound on an outer circumferential surface of the drum main body 442 in a rotational axial direction, e.g. wound at 90 degrees. Otherwise, the cleaning member 444 may be wound at below or above 90 degrees.

The first drum coupling part 446 may include a column-shaped first projection 4462 formed on a surface of the first drum coupling part 446 and projecting to the drum main body 442. The first projection 4462 formed on a surface of the first drum coupling part 446 and facing the drum main body 442 is inserted into and fixed to the first groove 4422 formed in a first end of the drum main body 442, and a second surface of the first drum coupling part 446 may be rotatably coupled to a belt pulley 472 (refer to FIG. 4) of the first drum supporter 47. Accordingly, the brush drum 44 may rotate along with a rotation of the belt pulley.

The second drum coupling part 448 may include a column-shaped second projection 4482 formed on a surface of the second drum coupling part 448 and projecting to the drum main body 442. Like the first drum coupling part 446, the second projection 4482 formed on a surface of the second drum coupling part 448 is inserted into and fixed to the second groove 4424 formed in a second end of the drum main body 442, and a second surface of the second drum coupling part 448 may be rotatably coupled the second drum supporter 48 (refer to FIG. 4).

Figure 9:
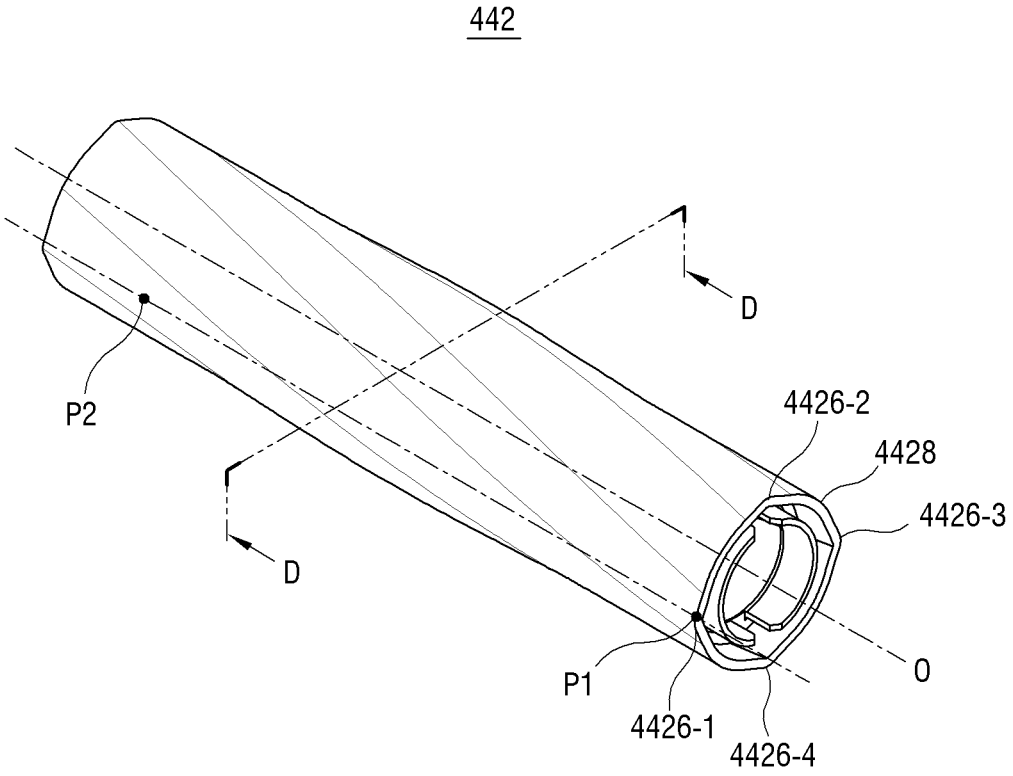
FIG. 9 is a perspective view of a drum main body in FIG. 7.

FIG. 9 is a perspective view of the drum main body 442 in FIG. 7.

Referring to FIG. 9, the drum main body 442 may include, without limitation, e.g. four convex portions 4426-1 to 4426-4 that project in a radial direction. The four convex portions 4426-1 to 4426-4 may be formed at equal intervals in a circumferential direction. The four convex portions 4426-1 to 4426-4 may spirally extend in an axial direction.

Two adjacent convex portions 4426-1 and 4426-4 may overlap with each other in an axial direction. A first point P1 of the first convex portion 4426-1 and a second point P2 of the fourth convex portion 4426-4 refer to the overlapping points in an axial direction. Surely, the first and second points P1 and P2 are described as an example, and combinations of other numerous overlapping points may be available. In order for two convex portions 4426-1 and 4426-4 to overlap with each other in an axial direction, the four respective convex portions 4426-1 to 4426-4 should be spirally twisted by at least 120 degrees in an axial direction. As a result, at the time of cleaning, only one point of the lowest convex portion in the rotating brush drum 44 contacts a floor cleaning surface and as rotation is proceeded with, the contact point may move in a spirally extension direction of the convex portion. At the time of cleaning, only a part of the convex portion that is lowest from an outer circumferential surface of the brush drum 44 contacts a floor cleaning surface, thereby reducing frictional force and noise.

According to a modified embodiment, on the drum main body 442, one convex portion, or two convex portions, or three convex portions or five or more convex portions which spirally extend in a rotational axial direction may be provided. Depending on the number of the convex portions, the angle at which the convex portions are spirally twisted may vary.

According to a modified embodiment, an internal shape of the drum main body 442 having at least one of convex portions 4426-1 to 4426-4 may vary including circular and polygonal shapes.

According to a modified embodiment, the angle at which at least one of convex portions 4426-1 to 4426-4 is twisted in a rotational axial direction may vary including 120 degrees.

According to a modified embodiment, the contact point of each of the convex portions 4426-1 to 4426-4 may be one or three or more points that overlap with one another.

Figure 10:
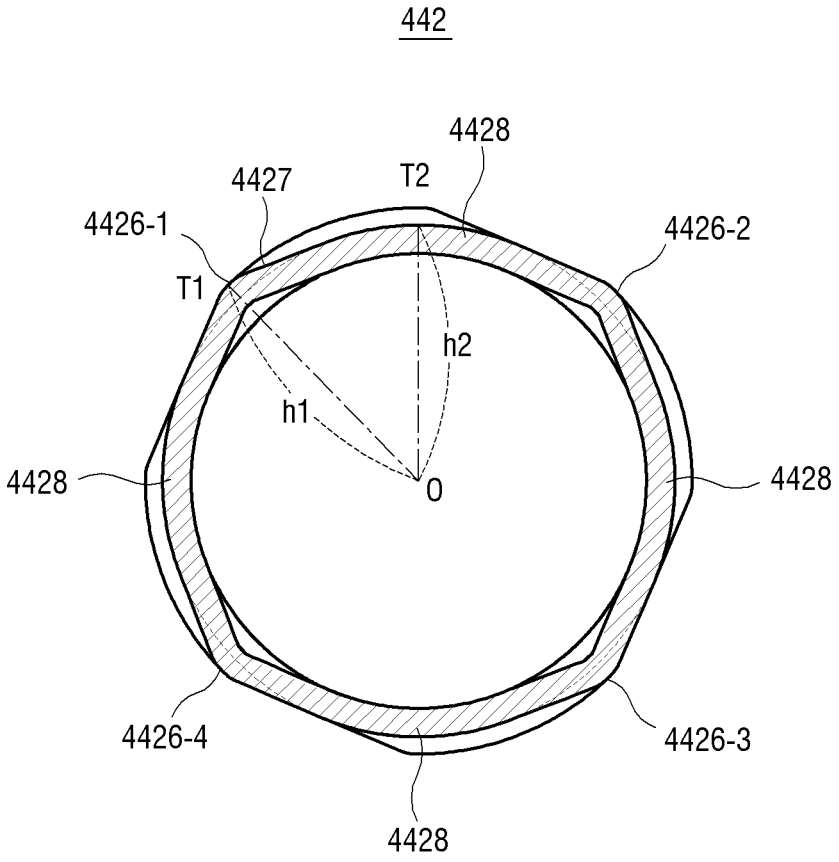
FIG. 10 is a cross-sectional view taken along line D-D in FIG. 9.

FIG. 10 is a cross-sectional view taken along line D-D in FIG. 9.

Referring to FIG. 10, four arches 4428 may be provided among four convex portions 4426-1 to 4426-4. The four arches 4428 may be provided at equal intervals according to the placement of the four convex portions 4426-1 to 4426-4 in a circumferential direction. With respect to the arches 4428, a height h2 from a center of rotation O of the drum main body 442 is lower than a height h1 of the convex portions 4426-1 to 4426-4. As a result, at the time of rotation, an outer circumferential surface of the cleaning member 444 which projects corresponding to the convex portions 4426-1 to 4426-4 may contact a cleaning surface floor unlike the outer circumferential surface of the cleaning member 444 corresponding to the arches 4428.

The four arches 4428 may have a curvature the radius of which is the height h2. The four convex portions 4426-1 to 4426-4 may have an inclined surface 4427 that is gradually inclined toward the adjacent arches 4428. The four convex portions 4426-1 to 4426-4 gradually change from a peak T1 to a base T2 located in the arches 4428, thereby preventing a gap from being caused when the base 4442 (Refer to FIG. 8) of the cleaning member 444 is attached to an outer circumferential surface of the drum main body 442.

Figure 11:
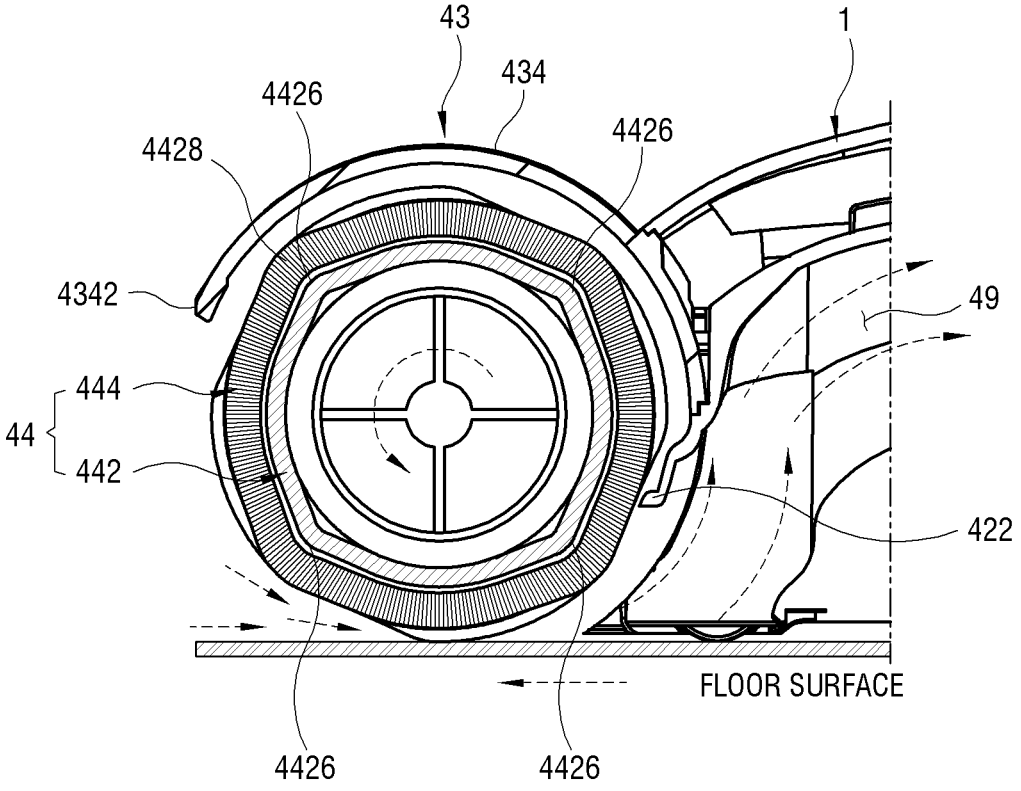
FIG. 11 illustrates a brush drum of the vacuum cleaner that is in contact with a floor cleaning surface according to the first embodiment of the disclosure.

FIG. 11 illustrates the brush drum 44 of the vacuum cleaner 1 that is in contact with a floor cleaning surface according to the first embodiment of the disclosure.

Referring to FIG. 11, an outer surface of the cleaning member 444 contacting a floor cleaning surface corresponds to the lowest one of the convex portions 4426-1 to 4426-4, and the remaining portion of the cleaning member 444 may float from a floor leaving a predetermined space therefrom. During cleaning, through such space, air is continuously introduced from the front, thereby preventing an air suction passage from being vacuum and accordingly preventing the suction unit 4 from adhering to a cleaning surface.

A housing 434 of the upper cover 43 covers a part of an outer circumferential surface of the brush drum 44. By an outer surface of the cleaning member 444 corresponding to a relatively lower arch 4428, a space may be provided between a part of an outer circumferential surface of the brush drum 44 and an inner surface of the housing 434. As a result, noise caused between an outer surface of the rotating brush drum 44 and an inner surface of the housing 434 may be reduced. In particular, issues of noise and damage to an inner surface of the housing 434 which are caused when large dirt stuck in the cleaning member 444 passes through a space between an outer surface of the brush drum 44 and an inner surface of the housing 434 through the contacting portion 422.

Figure 12:
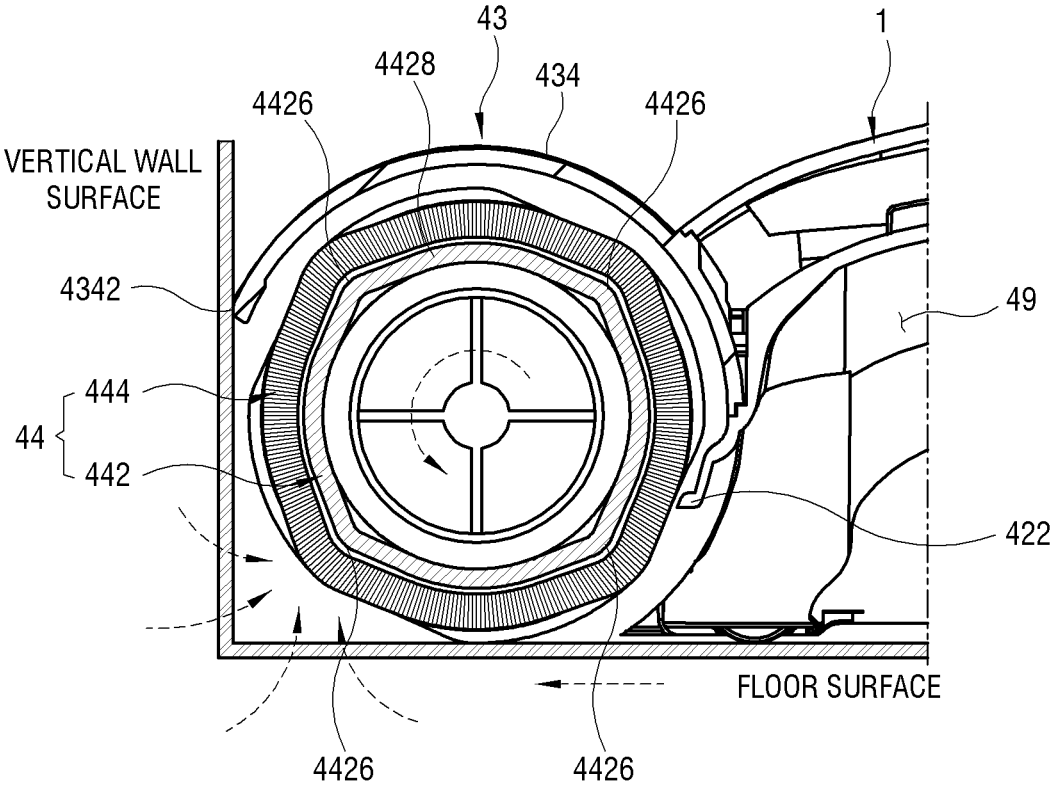
FIG. 12. illustrates the brush drum of the vacuum cleaner that is in contact with a corner cleaning surface according to the first embodiment of the disclosure.

FIG. 12. illustrates the brush drum 44 of the vacuum cleaner 1 that is in contact with a corner cleaning surface according to the first embodiment of the disclosure.

Referring to FIG. 12, the housing 434 surrounds the brush drum 44 from a side opposite to a floor and extends to a front of the suction unit 4. A front end 4342 of the housing 434 may project as high as, or higher than, an outer surface of the brush drum 44, in a vertical direction.

At the time of cleaning a corner, if the brush drum 44 is placed in the corner, the brush drum 44 may not be able to fully adhere to an upper wall surface due to the convex portion 4426 spirally extending, and air may be introduced from the upper side. Such introduction of upper air is not only unnecessary but also may cause loss of suction of the corner. In such case, the vacuum cleaner 1 according to an embodiment of the disclosure may cause air to be introduced only from a side to the corner as the front end 4342 of the housing which projects as high as, or higher than, an outer surface of the brush drum 44 may block an upper wall surface surrounding the corner. As a result, the vacuum cleaner 1 according to the first embodiment of the disclosure may block air introduced from an upper side to the corner to thereby suck dust or dirt in the corner without difficulty.

Figure 13:
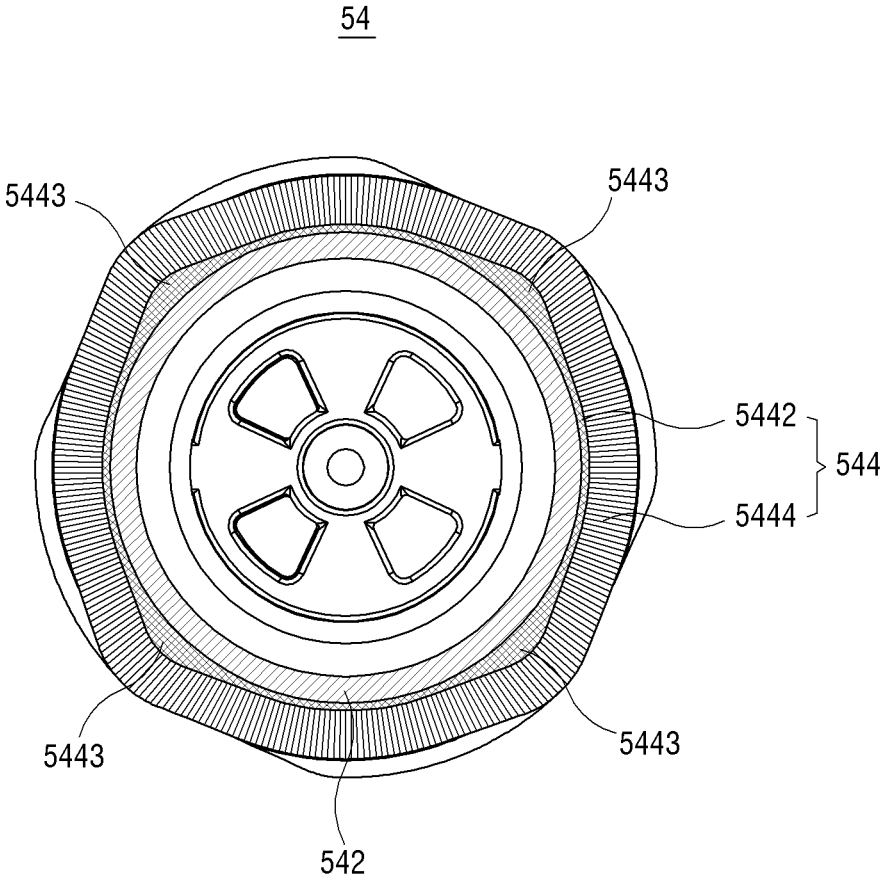
FIG. 13 is a cross-sectional view of a brush drum according to a second embodiment of the disclosure.
Figure 14:
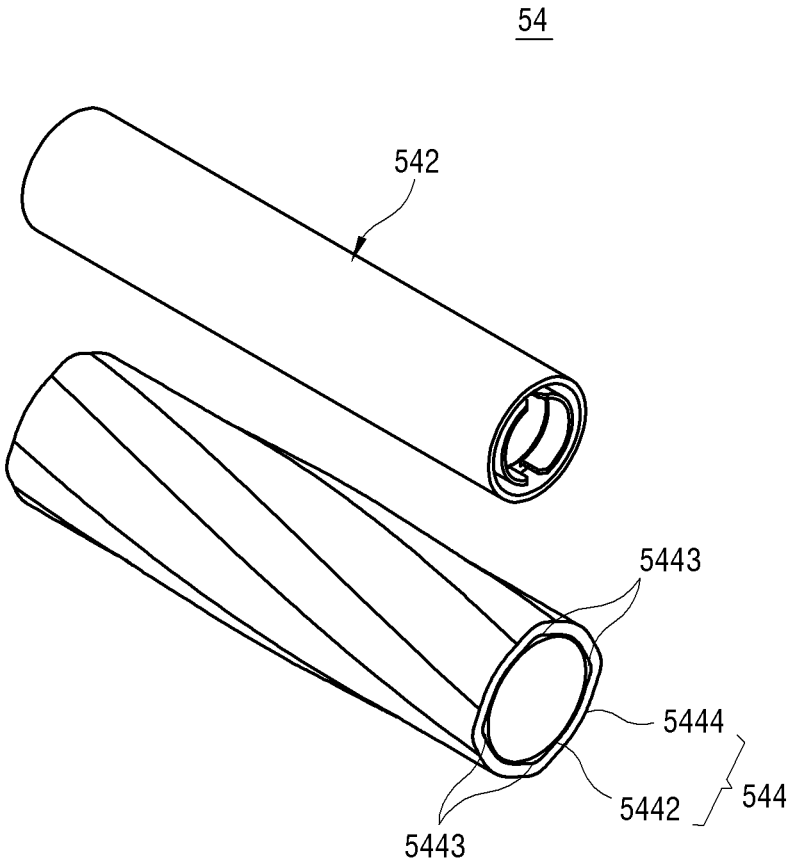
FIG. 14 is an exploded perspective view of the brush drum in FIG. 13.

FIG. 13 is a cross-sectional view of a brush drum 54 according to a second embodiment of the disclosure. FIG. 14 is an exploded perspective view of the brush drum 54 in FIG. 13.

Referring to FIGS. 13 and 14, the brush drum 54 may include a cylindrical drum main body 542 and a cleaning member 544 that surrounds the drum main body 542.

The drum main body 542 may be manufactured by injection molding with plastic, etc. The drum main body 542 may have a round section.

The cleaning member 544 may include a base 5442 attached to an outer circumferential surface of the drum main body 542 and a plurality of bristles 5444 supported by the base 5442.

The base 5442 may include four convex portions 5443 that project in a radial direction. Each of the convex portions 5443 may be spirally twisted in a rotational axial direction. Two adjacent convex portions 5443 may overlap with each other in a rotational axial direction.

Selectively, in the cleaning member 544, one convex portion, or two convex portions, or three convex portions or five or more convex portions which spirally extend in a rotational axial direction may be provided.

Figure 15:
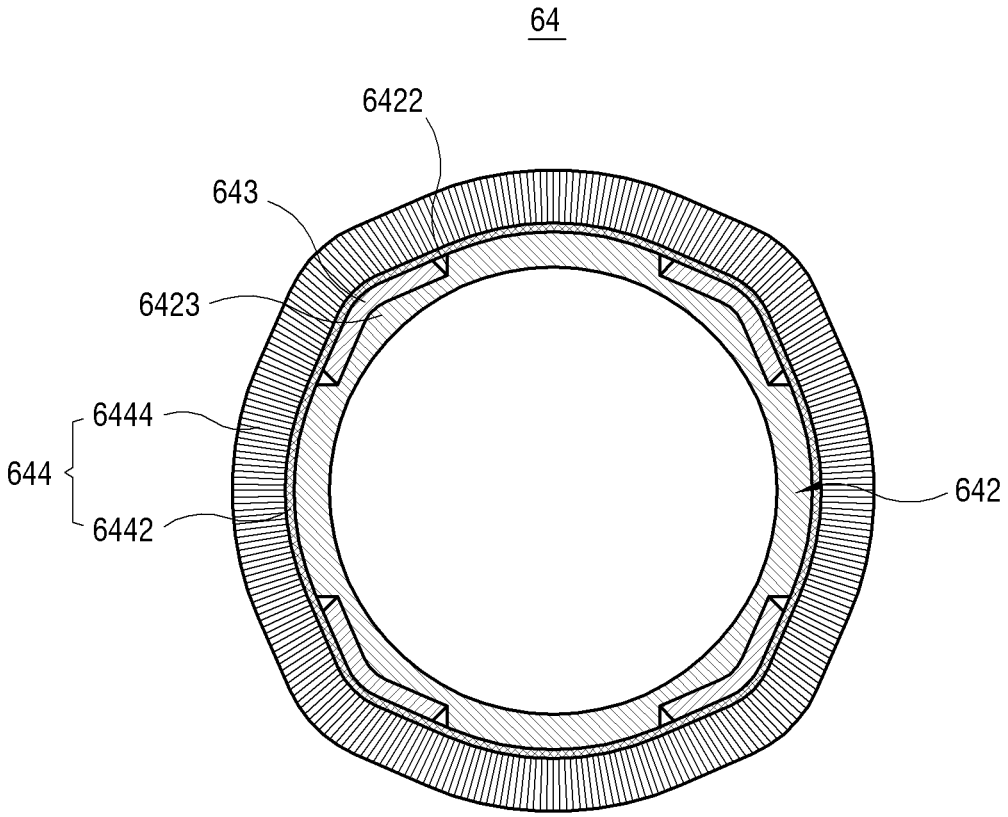
FIG. 15 is a cross-sectional view of a brush drum according to a third embodiment of the disclosure.
Figure 16:
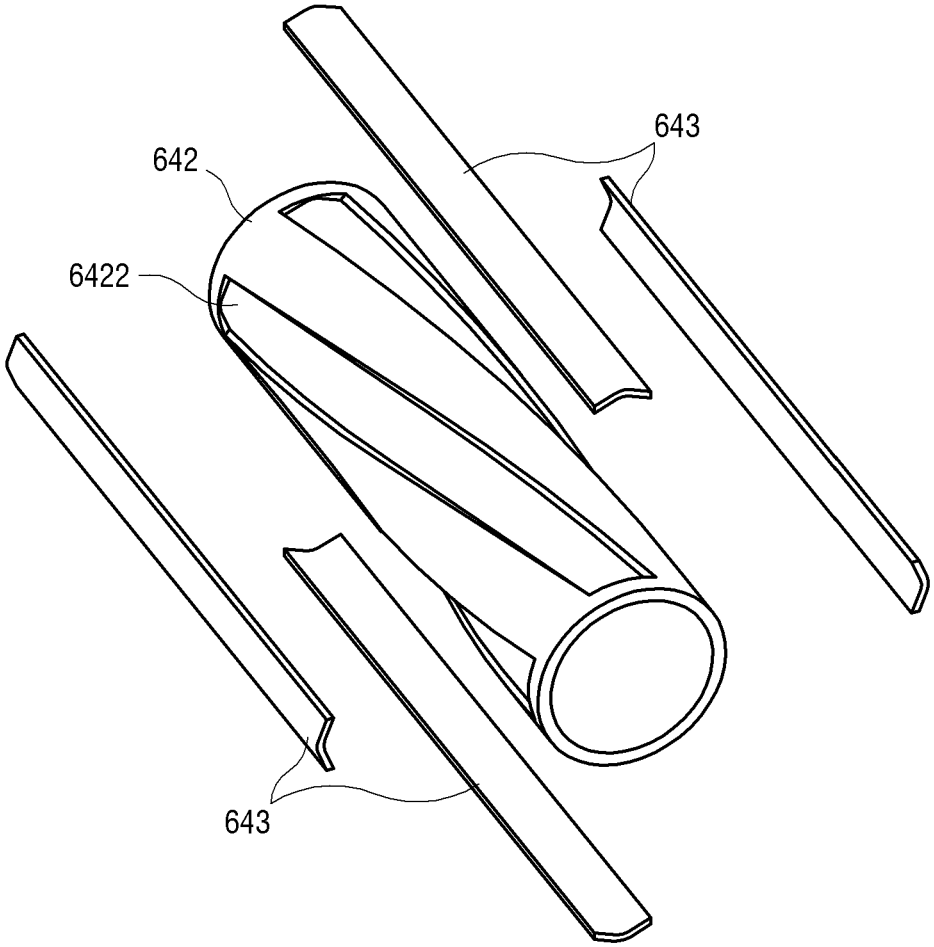
FIG. 16 is a perspective view of a drum main body and an elastic member in FIG. 15.

FIG. 15 is a cross-sectional view of a brush drum 64 according to a third embodiment of the disclosure. FIG. 16 is a perspective view of the drum main body 642 and an elastic member 643 in FIG. 15.

Referring to FIGS. 15 and 16, the brush drum 64 may include a cylindrical drum main body 642, the elastic member 643 and a cleaning member 644 surrounding the drum main body 642.

The drum main body 642 may be manufactured by injection molding with plastic, etc. The drum main body 642 may have a round section.

The drum main body 642 may include, e.g. four grooves 6422 formed on an outer circumferential surface thereof and spirally extending in an rotational axial direction. The four grooves 6422 may extend to be twisted by a predetermined angle, e.g. 90 degrees in an axial direction. Each of the grooves 6422 may include convex portions 6423 a center of which protrudes in a transverse direction. The grooves 6422 are not limited to four grooves.

The elastic member 643 may be inserted into the grooves 6422 of the drum main body 642 and attached thereto by an adhesive. The adhesive may include a double-sided tape. The elastic member 643 may be in a consistent thickness. The elastic member 643 may have a thickness so that the elastic member 643 may project as high as the convex portions 6423 from an outer circumferential surface of the drum main body 642 when the elastic member 643 is inserted into the grooves 6422. As another example, the elastic member 643 may be implemented by a double-shot injection molding or insert injection molding and formed in the grooves 6422 of the drum main body 642.

The elastic member 643 may include a material that is softer than the drum main body 642. The drum main body 642 may include a hard material for structural safety while the elastic member 643 may include a soft material to absorb shock.

The elastic member 643 may include a material that is more elastic than the drum main body 642, e.g. may include synthetic rubber, natural rubber, synthetic resin, plastic, etc.

The cleaning member 644 may include a base 6442 attached to an outer circumferential surface of the drum main body 642 and a plurality of bristles 6444 supported by the base 6442.

As above, the elastic member 643 of a soft material formed on a position corresponding to the convex portions 6423 may absorb shock cased when a protrusion part protruding by the convex portions 6423 contacts large dust or edgy object, thereby protecting the cleaning member 644.

Figure 17:
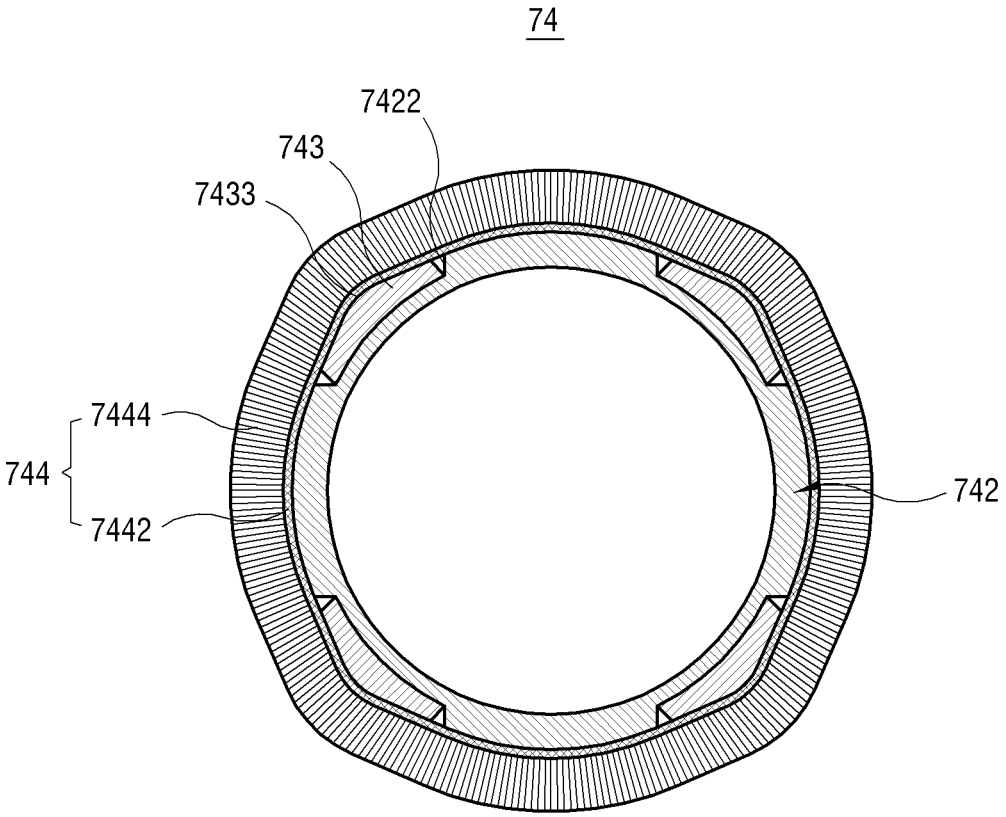
FIG. 17 is a cross-sectional view of a brush drum according to a fourth embodiment of the disclosure.

FIG. 17 is a cross-sectional view of a brush drum 74 according to a fourth embodiment of the disclosure.

Referring to FIG. 17, the brush drum 74 may include a drum main body 742, an elastic member 743 and a cleaning member 744 surrounding the drum main body 742.

The drum main body 742 may include, e.g. four grooves 7422 formed on an outer circumferential surface thereof and spirally extending in an rotational axial direction.

The elastic member 743 may be inserted into the grooves 7422 of the drum main body 742 and attached thereto. The elastic member 743 may include convex portions 7433 a center of which projects in a transverse direction.

The cleaning member 744 may include a base 7442 attached to an outer circumferential surface of the drum main body 742 and a plurality of bristles 7444 supported by the base 7442.

Figure 18:
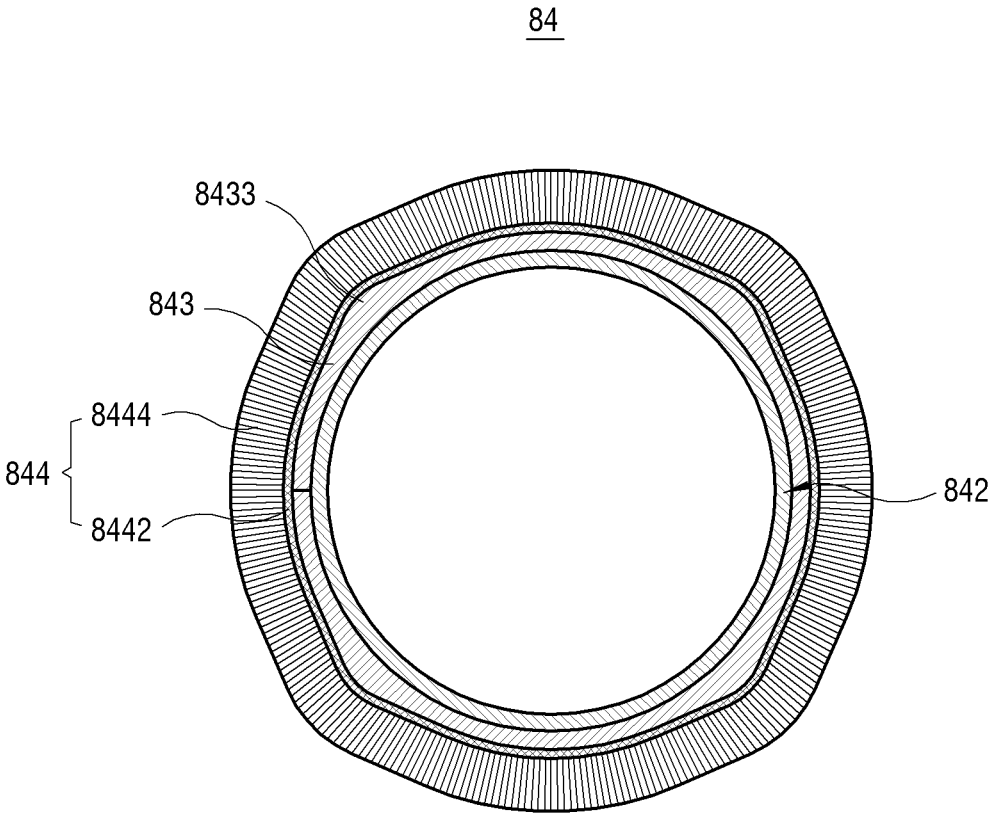
FIG. 18 is a cross-sectional view of a brush drum according to a fifth embodiment of the disclosure.
Figure 19:
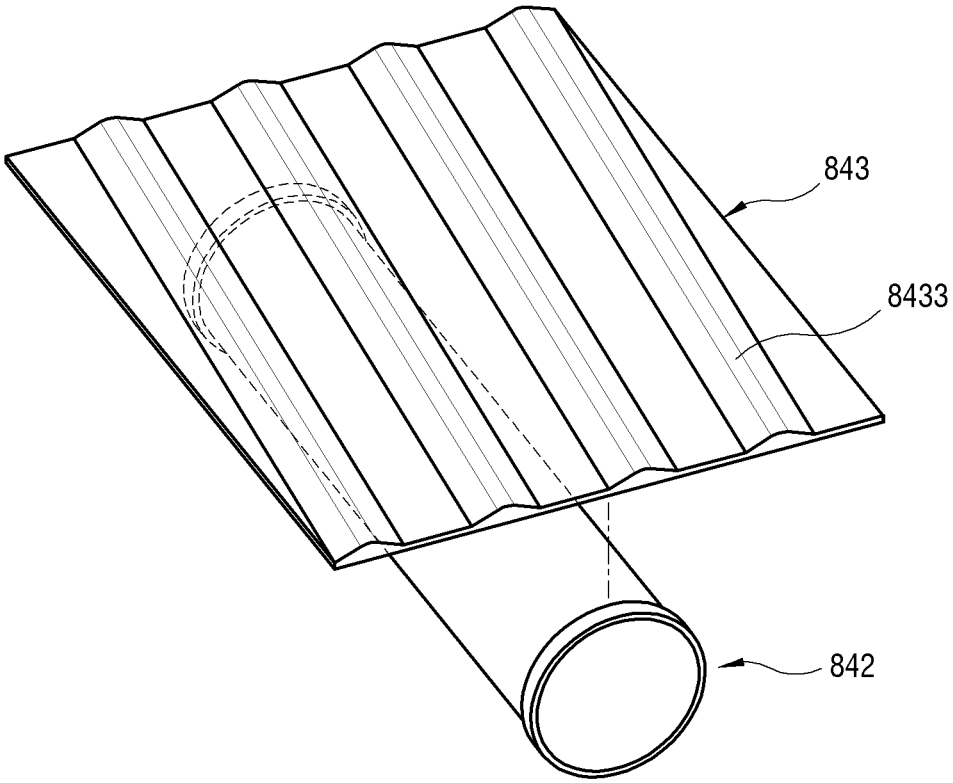
FIG. 19 is a perspective view of a drum main body and an elastic member in FIG. 18.

FIG. 18 is a cross-sectional view of a brush drum 84 according to a fifth embodiment of the disclosure. FIG. 19 is a perspective view of the drum main body 842 and an elastic member 843 in FIG. 18.

Referring to FIGS. 18 and 19, the brush drum 84 may include a drum main body 842, an elastic member 843 and a cleaning member 844 surrounding the drum main body 842.

The drum main body 842 may have a round section in a consistent thickness.

The elastic member 843 may be attached to an outer circumferential surface of the drum main body 842 to surround the same. The elastic member 843 may include, e.g. four convex portions 8433 that project in a radial direction and spirally extend in an axial direction.

As shown in FIG. 19, the elastic member 843 may include four convex portions 8433 diagonally extending on a square panel with an area corresponding to an outer circumferential surface of the drum main body 842. If the elastic member 843 surrounds an outer circumferential surface of the drum main body 843, the convex portions 8433 spirally extending in an axial direction may be formed.

According to another embodiment, the elastic member 843 may be shaped like a round ring to be put in the drum main body 842 rather than being provided as a square panel.

According to another embodiment, the elastic member 843 may have the convex portions 6433 having a different material from the remainder of the elastic member 843. For example, the convex portions 8433 may include an elastic and soft material, and the remainder may include a material less elastic than the convex portions 8433.

The cleaning member 844 may include a base 8442 attached to an outer circumferential surface of the elastic member 843 and a plurality of bristles 8444 supported by the base 8442.

Figure 20:
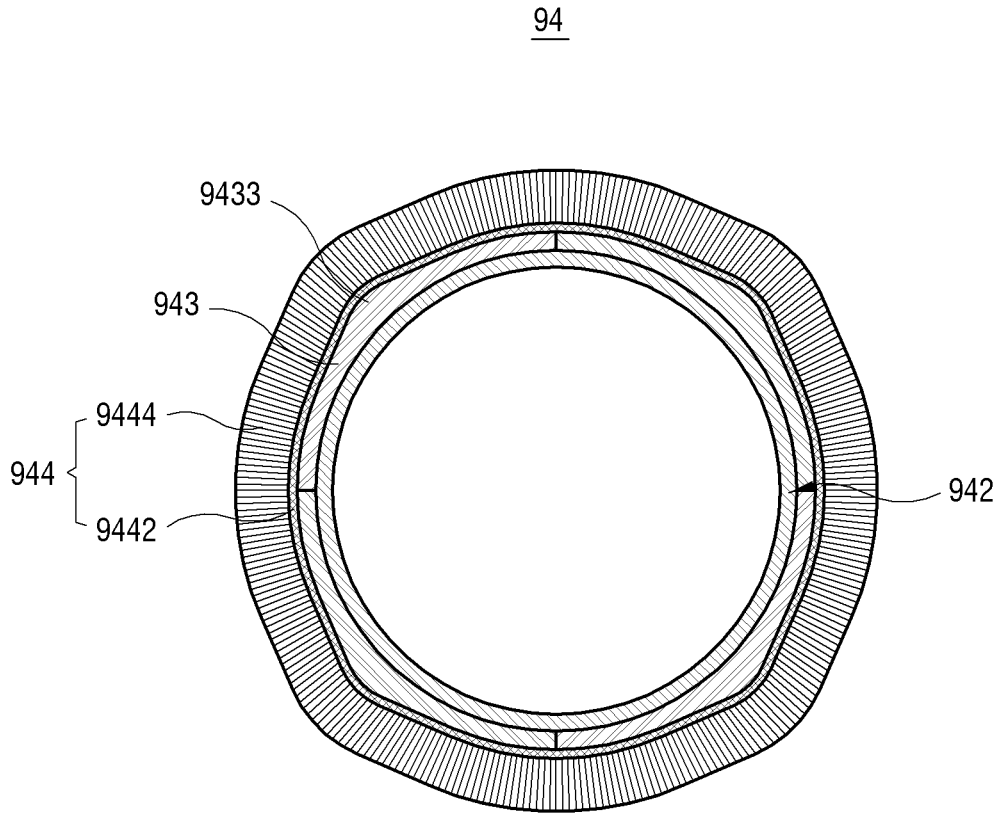
FIG. 20 is a cross-sectional view of a brush drum according to a sixth embodiment of the disclosure.
Figure 21:
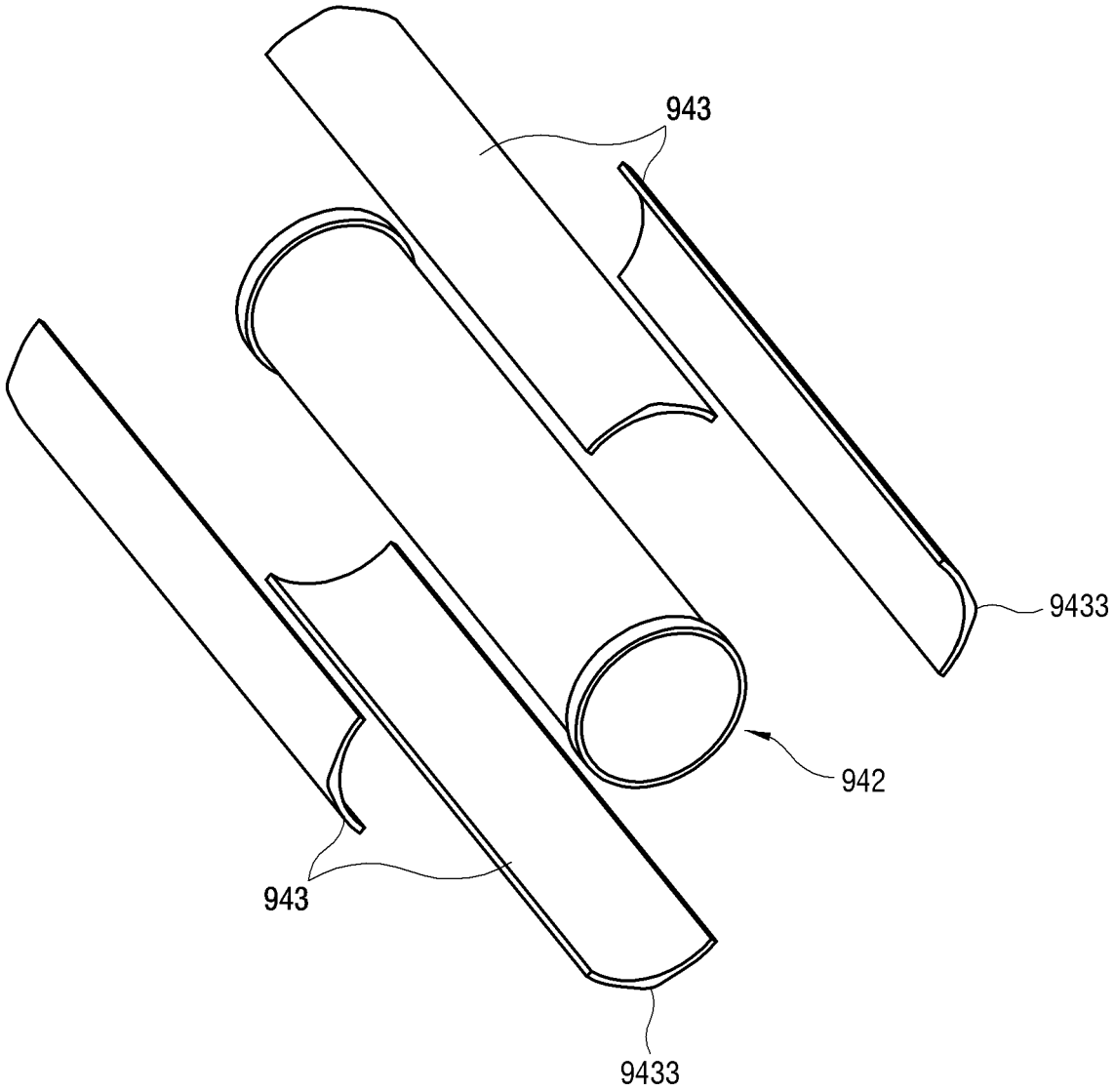
FIG. 21 is a perspective view of a drum main body and an elastic member in FIG. 20.

FIG. 20 is a cross-sectional view of a brush drum 94 according to a sixth embodiment of the disclosure. FIG. 21 is a perspective view of a drum main body 942 and an elastic member 943 in FIG. 20.

Referring to FIGS. 20 and 21, the brush drum 94 may include a drum main body 942, e.g. four elastic members 943 and a cleaning member 944 surrounding the drum main body 942.

The drum main body 942 may have a round section in a consistent thickness.

The elastic members 943 may be attached to an outer circumferential surface of the drum main body 942 to surround the same. The elastic members 943 may include convex portions 9433 that protrude in a radial direction and spirally extend in an axial direction.

As shown in FIG. 21, the four elastic members 943 may include convex portions 9433 a center of which protrude in a transverse direction. As the elastic members 943 surround an outer circumferential surface of the drum main body 943 at a predetermined angle, e.g. diagonally at 90 degrees, the convex portions 9433 spirally extending in an axial direction may be formed.

According to another embodiment, the elastic members 943 may be divided into two, or three or five or more elastic members.

The cleaning member 944 may include a base 9442 attached to an outer circumferential surface of the elastic member 943 and a plurality of bristles 9444 supported by the base 9442.

Figure 22:
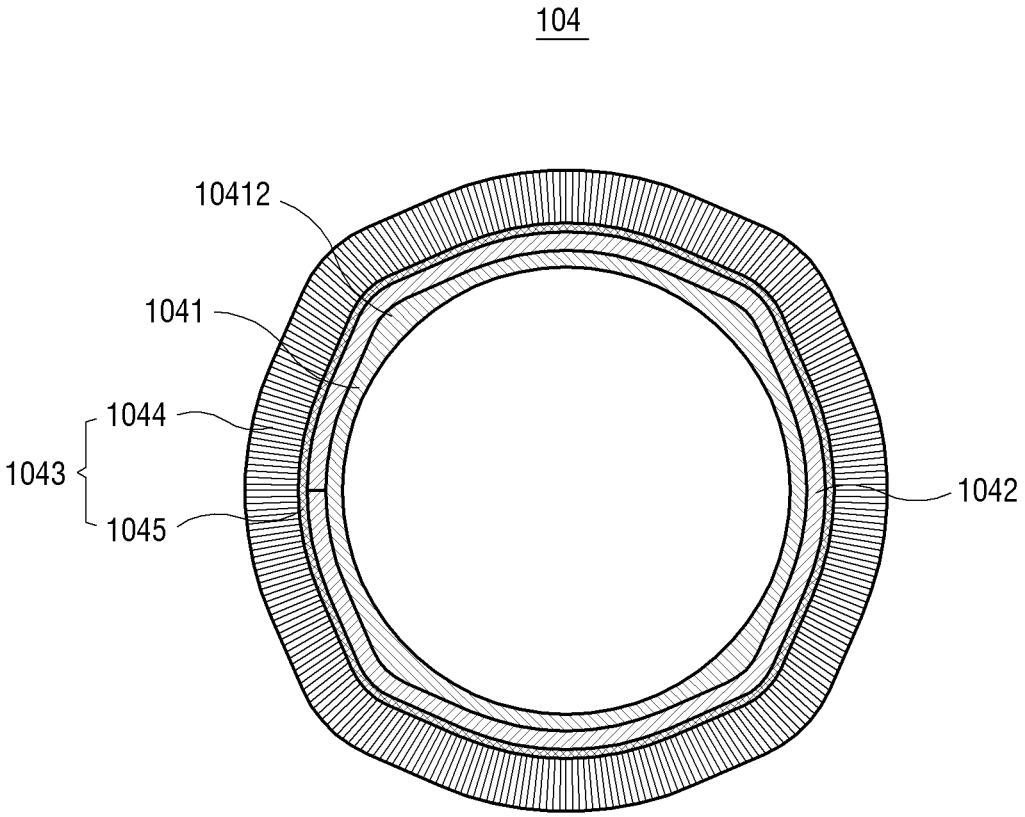
FIG. 22 is a cross-sectional view of a brush drum according to a seventh embodiment of the disclosure.

FIG. 22 is a cross-sectional view of a brush drum 104 according to a seventh embodiment of the disclosure.

Figure 23:
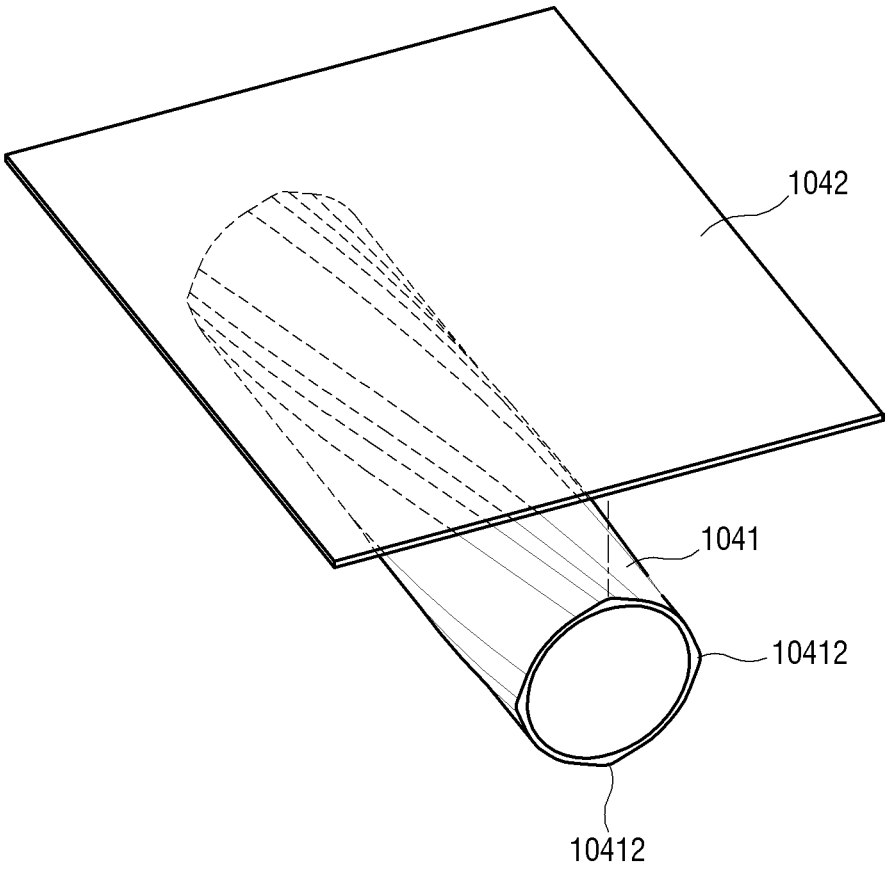
FIG. 23 is a perspective view of a drum main body and an elastic member in FIG. 22.

FIG. 23 is a perspective view of a drum main body 1041 and an elastic member 1042 in FIG. 22.

Referring to FIGS. 22 and 23, the brush drum 104 may include a cylindrical drum main body 1041, an elastic member 1042 and a cleaning member 1043 surrounding the drum main body 1041.

The drum main body 1041 may be manufactured by injection molding with plastic, etc. The drum main body 1041 may have a round section.

The drum main body 1041 may include, e.g. four convex portions 10412 that spirally extend on an outer circumferential surface of the drum main body 1041 in an axial direction. The four convex portions 10412 may extend to be twisted by a predetermined angle, e.g. 90 degrees in an axial direction. The convex portions 10412 are not limited to four portions, and the twisted angle is not limited to 90 degrees.

The elastic member 1042 may be attached to an outer circumferential surface of the drum main body 1041 by an adhesive. The adhesive may include a double-sided tape. The elastic member 1042 may be in a consistent thickness. As a result, the elastic member 1042 may project as high as the convex portion 10412 of the drum main body 1041.

The cleaning member 1043 may include a base 1044 attached to an outer circumferential surface of the drum main body 1041 and a plurality of bristles 1045 supported by the base 1044.

As described above, the vacuum cleaner according to the disclosure may make less noise and consume less power as frictional force between a cleaning surface and a drum is reduced and a load of rotation of the drum is reduced.

In addition, the vacuum cleaner according to the disclosure may cause a front end of a housing surrounding a brush drum to be as high as, or higher than, an outer surface of the brush drum in a vertical direction to block an inflow of air in a vertical direction when a corner is cleaned, thereby more effectively sucking dust from the corner.

Although a few embodiments have been shown and described, it will be appreciated by those skilled in the art that changes may be made in these embodiments without departing from the principles and spirit of the invention, the scope of which is defined in the appended claims and their equivalents.

What is claimed is:

1. A vacuum cleaner comprising:

a cleaner main body configured to generate suction force; and a suctioner having a suction inlet to suck dust by the suction force and a brush drum provided at the suction inlet to sweep dust on a floor, wherein the brush drum comprises:

a drum main body rotatably provided in an axial direction of the brush drum, a plurality of convex portions formed to project from an outer circumferential surface of the drum main body in a radius direction of the brush drum and spirally extend along the axial direction of the brush drum, a plurality of arches formed on the outer circumferential surface of the drum main body with a lower height than the plurality of convex portions, respectively between the plurality of convex portions, and to spirally extend along the axial direction of the brush drum, a plurality of inclined surfaces formed to be gradually inclined from each of the plurality of convex portions to each of the plurality of arches, the convex portion and the arch being adjacent each other, and a cleaning member surrounding an outer circumferential surface of the plurality of convex portions, the plurality of arches and the plurality of inclined surfaces along a rotation direction of the drum main body.

2. The vacuum cleaner according to claim 1, wherein:

the drum main body is cylindrical.

3. The vacuum cleaner according to claim 1, wherein the convex portions are first convex portions, and portions of an outer circumferential surface of the cleaning member project away from the first convex portions and the portions of the outer circumferential surface of the cleaning member are second convex portions.

4. The vacuum cleaner according to claim 3, wherein the first convex portions and the second convex portions are formed to surround a rotational shaft of the brush drum and the second convex portions comprise at least one contact point configured to contact a surface of the floor.

5. The vacuum cleaner according to claim 3, wherein the plurality of arches have a lower height than the second convex portions and are arranged between the second convex portions, respectively.

6. The vacuum cleaner according to claim 5, wherein the plurality of arches have a radius of curvature from a center of rotation.

7. The vacuum cleaner according to claim 1, wherein the plurality of convex portions are configured to have a predetermined radius of curvature in a circumferential direction of the brush drum.

8. The vacuum cleaner according to claim 1, wherein the suctioner comprises a housing partially surrounding the brush drum.

9. The vacuum cleaner according to claim 8, wherein the housing is configured to surround the brush drum at a side of the brush drum opposite the floor and comprises a front end formed to extend along a front direction of the suctioner, and wherein the front end of the housing is configured to project as long as, or longer than, the brush drum in the front direction.

10. A vacuum cleaner comprising:

a cleaner main body configured to generate suction force; and a suctioner having a suction inlet to suck dust by the suction force and a brush drum rotatably provided at the suction inlet to sweep dust on a floor, wherein the brush drum comprises:

a plurality of convex portions formed to project from an outer circumferential surface of the brush drum in a radius direction of the brush drum and spirally extend along a rotational axial direction of the brush drum, a drum main body which includes the plurality of convex portions and the outer circumferential surface of the brush drum on which the plurality of convex portions are formed, a plurality of arches formed on the outer circumferential surface of the drum main body with a lower height than the plurality of convex portions, respectively between the plurality of convex portions, and to spirally extend along the axial direction of the brush drum, a plurality of inclined surfaces formed to be gradually inclined from each of the plurality of convex portions to each of the plurality of arches, the convex portion and the arch being adjacent each other, and a cleaning member surrounding an outer circumferential surface of the plurality of convex portions, the plurality of arches and the plurality of inclined surfaces along a rotation direction of the drum main body.

11. The vacuum cleaner according to claim 10, wherein a respective height of a plurality of bristles is the same as each other.

12. The vacuum cleaner according to claim 10, wherein a plurality of bristles comprises the same or two or more materials.

13. The vacuum cleaner according to claim 12, wherein the plurality of bristles comprise at least one of nylon filaments, silver yarn filaments or carbon filaments.

* * * * *